US005216790A

United States Patent [19]

Eschenbach

[11] Patent Number: 5,216,790

[45] Date of Patent: Jun. 8, 1993

[54] NEEDLED NONWOVEN FABRIC

[75] Inventor: Paul W. Eschenbach, Moore, S.C.

[73] Assignee: Milliken Research Corporation, Spartanburg, S.C.

[21] Appl. No.: 928,625

[22] Filed: Aug. 12, 1992

Related U.S. Application Data

[63] Continuation of Ser. No. 618,977, Nov. 28, 1990, abandoned, which is a continuation-in-part of Ser. No. 603,434, Oct. 26, 1990.

[51] Int. Cl.[5] ..... D04H 1/48; D04H 11/08

[52] U.S. Cl. ..... 28/112; 428/95; 428/288; 428/296; 428/297

[58] Field of Search ..... 28/112

[56] References Cited

U.S. PATENT DOCUMENTS

| | | | |
|---|---|---|---|
| 3,889,028 | 6/1975 | Hosterey | 428/88 |
| 3,977,055 | 8/1976 | Gilpatrieb | 26/12 |
| 4,258,093 | 3/1981 | Benedyk | 428/85 |
| 4,391,866 | 7/1983 | Pickens et al. | 428/92 |
| 4,391,866 | 7/1983 | Pickens, Jr. et al. . | |

*Primary Examiner*—James C. Cannon

*Attorney, Agent, or Firm*—Terry T. Moyer; Earle R. Marden

[57] ABSTRACT

Method to produce a non-woven needled fabric in which the needled fabric includes 10–35% of low melt fusible fibers to aid in holding the non-woven fabric together when passed through and over to melt the fusible fibers and then allow to cool and bind the fabric together.

1 Claim, 3 Drawing Sheets

NEEDLED NONWOVEN FABRIC

This is a continuation of prior application Ser. No. 618,977, filed Nov. 28, 1990, and now abandoned, which is a continuation-in-part of prior application Ser. No. 603,434, filed on Oct. 26, 1990 of Paul William Eschenbach for CUT PILE NEEDLED NONWOVEN FABRIC.

This invention relates to a non-woven fabric and a method of making same and, more particularly, to a non-woven fabric made from a needled batt of non-woven staple fibers from a blend of fibers including low melt fusible fibers.

There has been on the market for many years fabrics having a backing member, such as jute or burlap, or the like, which may or may not have a non-woven batt of staple fibers secured thereto as by the use of adhesive, needle bonding, fusion, or the like. Yarn is tufted through the backing and/or through the batt. The ends of the tufts are then napped, tigered, or cut to produce a fleece-like material, see U.S. Pat. No. 3,152,381 issued Oct. 13, 1964 to Priester, et al, and U.S. Pat. No. 2,913,803 issued Nov. 24, 1959 to Dodds, for a frieze effect material, see U.S. Pat. No. 3,341,386 issued Sep. 12, 1967 to White, et al. All of this prior art has in common the use of tufting to provide looped pile, the loops of which are then napped or cut to product the fabric having a deep soft surface thereon.

U.S. Pat. No. 3,674,618 issued Jul. 4, 1972 to Spann discloses a process for making an imitation sliver knit pile fabric wherein a thin thermoplastic film is placed on a non-woven layer of stable fibers. The fibers are needled through the film and the film is thermally bonded to the fibers. The layer of fibers is then napped, sheared and polished to produce an apparel fabric that is soft and pliable.

U.S. Pat. No. 3,347,735 issued Oct. 17, 1967 to Sissons shows attaching a reinforcing member to a surface of a web of stable fibers. The web and reinforcing member are needle punched from the side of the web opposite the reinforcing member to force fibers through the reinforcing member to form fiber tufts. The resulting product is immersed in boiling water to crimp the fibers.

U.S. Pat. No. 4,391,866 issued Jul. 5, 1983 to Pickens, et al., describes a cut pile fabric made from a needled batt of non-woven fibers in which a series of loops is aligned in the cross-machine direction and then tigered to break a number of the filaments in the formed loops. Then to even out the surface of the fabric the surface of the fabric is polished and sheared in order to produce a suitable smooth cut pile surface.

It is therefore an object of the invention to provide a method to provide a cut pile fabric from a needled non-woven fabric which does not have one or more of the problems inherent in the structures of the above fabrics.

Other objects and advantages of the invention will become readily apparent as the specification proceeds to describe the invention with reference to the accompanying drawings, in which.

Figure 1:
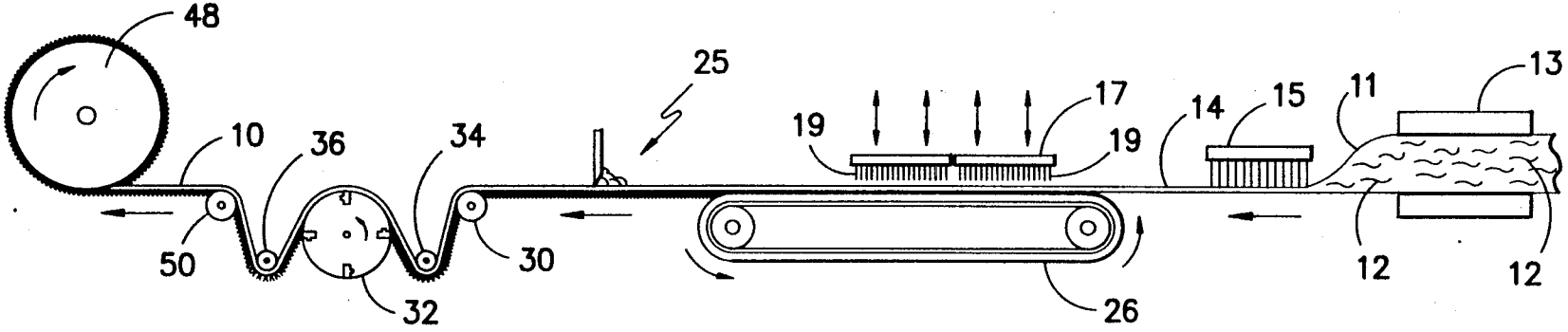
FIG. 1 is a schematic representation of the process to produce the desired fabric.
Figure 2:
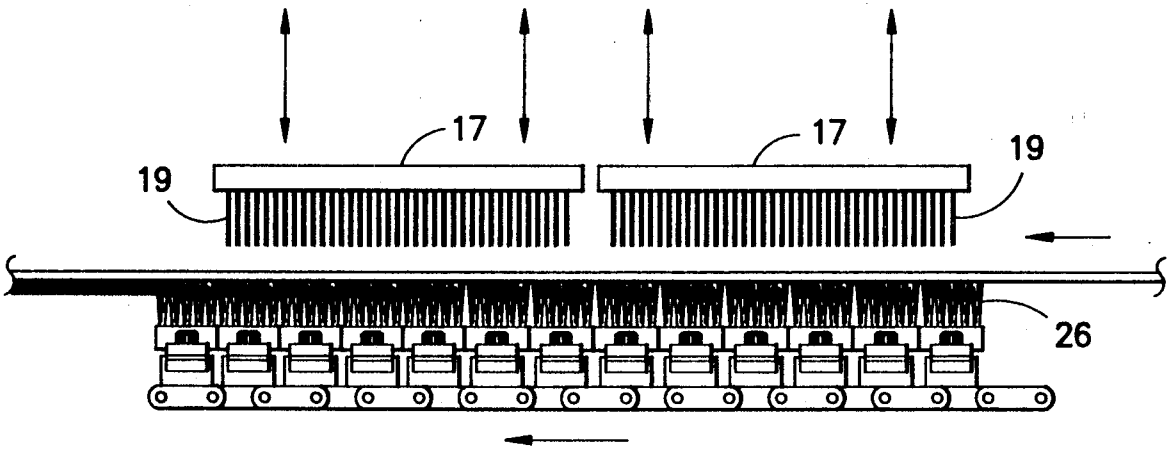
FIG. 2 is a schematic representation of the loop-forming process.
Figure 3:
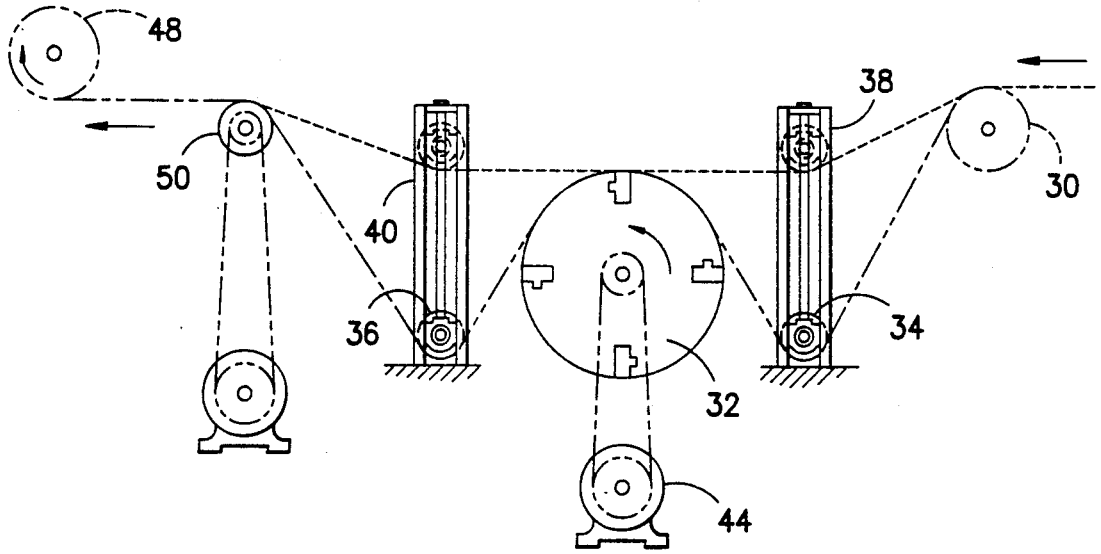
FIG. 3 represents the loop cutting apparatus to cut the loops of the needled fabric.
Figure 7:
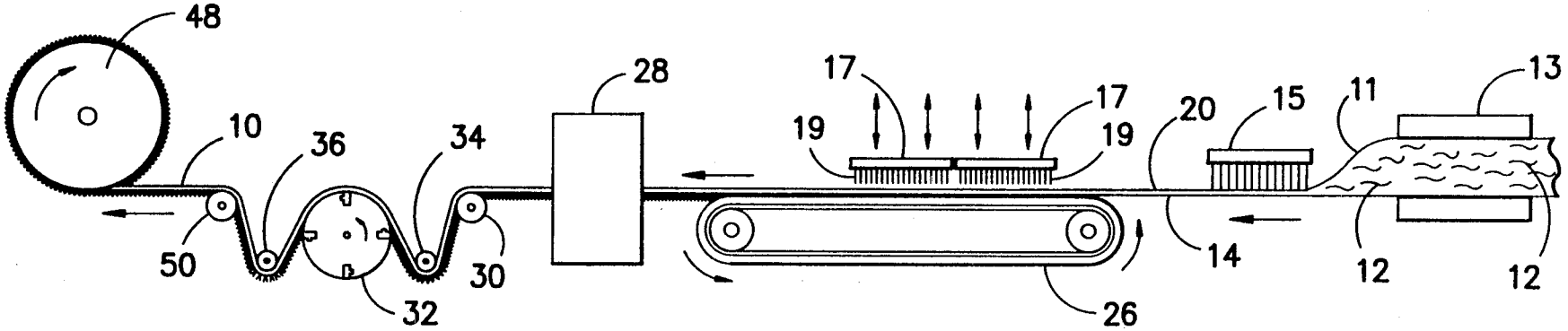
FIG. 7 is a modification of the process illustrated in FIG. 1.

Looking now to the drawings, FIGS. 1 & 7 schematically represent the preferred embodiments of producing the cut pile fabric. FIGS. 1 & 7 show a continuous process but obviously the fabric or webs being processed can be taken up at the end of any step in the process and carried on a roll or like to the next step in the process so long as the sequential steps of the process shown are followed.

FIGS. 1–6 illustrate one preferred form of fabric 10 and the method of manufacturing same. Non-woven staple fibers 12 are laid up in a continuous web 11, as in FIG. 1, using, for instance, a conventional lapper 13 whereupon as the web 11 is advanced past a needle loom 15, it is needled into a continuous batt 14, using conventional needles. The batt 14 may be needled from both sides or from one side, as shown depending upon the materials of the fibers and the desired weight of the finished fabric. In a preferred form of the steps of manufacture, and assuming that the batt 14 was needled from one side only, which was from above in FIG. 1, the needled batt 14 may be turned over or reversed before it is fed to a loop-forming needle loom 17. The turning of the batt 14 may be accomplished by rolling the batt onto a roller (not shown) as it leaves the needle loom 15, after which the roller is reversed and the batt 14 is fed to the needle loom 17 so that the batt 14 is punched from the side of the batt opposite to the single needle. If the batt 14 was needled from both sides, it is fed to the needle loom 17 oriented so that the needles penetrate first into the first punched side so that the loops project from the last-punched side. The batt 14 is advanced past the needle loom 17 where it is formed into loops 18. The needle loom 17 uses fork needles 19 which pass through one surface, such as a back surface 20, of the batt 14 to push fibers caught on the ends of the needles through another surface, such as a face surface 22, to form the loops 18 extending from said face surface.

Figure 6:
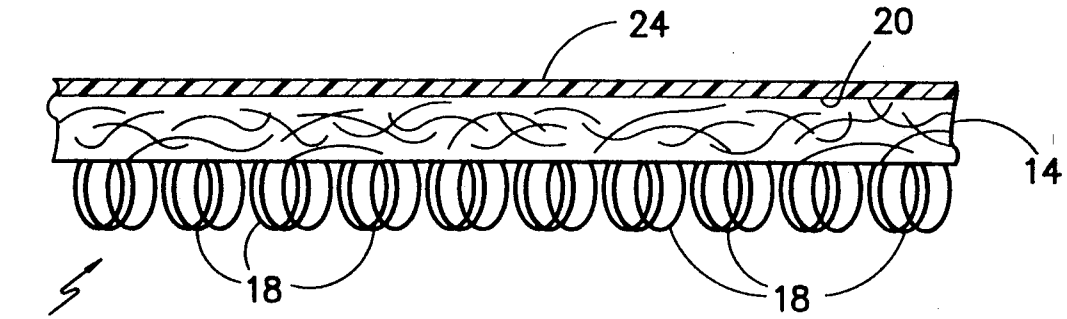
FIG. 6 is a cross-section view of the fabric with loops formed therein taken on line 6—6 of FIG. 4.

To provide a random effect of the loops 18 as shown in FIG. 6 the forked needles are aligned in the transverse direction and staggered in the machine direction so that the openings in the loops in the machine direction are staggered from row to row in the machine. To accomplish this arrangement a brush conveyor 26 is used to allow the staggered needles to pass therethrough randomly after needling and to mount the needles 19 so that the openings in the form run perpendicular to the machine direction of the needle loom 17.

After the loops 18 have been formed in the batt 14 the batt 14 is moved downstream to where a backing 24, such as a coating of latex, FIG. 1, or the like, is applied to the back surface 20 using a conventional latex applicator 25 to lock the fibers 12 of the batt 14 and, if particular, the fiber ends of the loop 18 that are still in the batt and to add stiffness to the batt.

The applicator 25, as shown in FIG. 1, is a commercially available type which applies the backing 24 as the batt 14 is moved past the applicator with the backing surface facing upward. In place of the latex backing 24, when the nature of the material of the fibers in the batt 14 is thermoplastic or a blended composition containing fusible fibers; or the like, the back surface 20 may have the backing 24 formed by fusing (not shown) using an appropriate heat roll or oven 28 as shown in FIG. 7, or the like, which is intended to lock the ends of the fibers forming the loops and to add stiffness to the batt. The backing 21 gives strength and stability, as well as stiffness, to the finished fabric.

Figure 4:
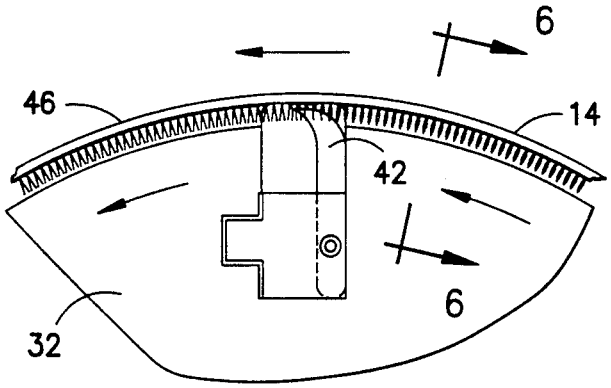
FIGS. 4 and 5 represent the two specific ways to cut the formed loops.
Figure 5:
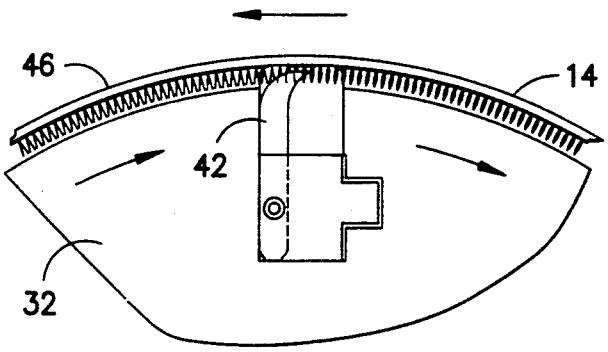

From the applicator 25 the backed looped batt 14 (FIG. 6) with the staggered loops 18 facing downward is passed over a guide roll 30 to the loop cutting rotor 32 of the type disclosed in U.S. Pat. No. 3,977,055. Located on both sides of the rotor 32 are a pair of adjustable rolls 34 and 36 mounted, respectively, in support tracks 38 and 40. Support tracks allow the rolls 34 and 36 to move upward and downward to adjust the position of the looped batt 14 with respect to the blades 42 in the cutting rotor 32. As described in U.S. Pat. No. 3,977,055 the blades 42 sever almost 100% of all of the loops 18 with a minimum of waste to provide a cut pile fabric 46. As shown in FIGS. 4 & 5, the rotor 32 can be driven in the direction of travel of the looped batt 14 (FIG. 4) by the motor 44 or opposite to the direction of travel of the batt (FIG. 5). After the loops 18 of the batt 14 have been cut the cut pile fabric 46 is delivered to the take-up 48 by the driven roll 50 whereat it is taken up.

EXAMPLE

A typical fabric made by the herein-disclosed apparatus and method will be comprised of 18 denier, $3\frac{1}{4}''$ staple nylon having a pile height of 4–5 mm. Depending on the use of the cut pile fabric the weight can vary from 6 to 30 oz/yd$^2$. If the apparatus of FIG. 7 is employed the web 12 can be blended with 3–6 denier low melt polyethylene or like fibers.

A plurality of layers of non-woven staple fibers of $3\frac{1}{4}''$ lengths of nylon was lapped into a continuous web 11 which was then needle punched to form a continuous batt 14. The needle punched batt 14 was then punched on a loom 17 to form loops 18. The fork needles 19 used on the needle loom 17 were oriented with the opening between the points of the fork disposed perpendicular to the machine direction. The batt 14 was then moved past applicator 25 whereupon a backing 24 of latex, identified as SBR, was applied on the back surface 20 at the rate of 8 ounces per square yard and was dried. The latexed batt 14 was then passed at the rate of 15 feet per minute through the rotor 32 rotating at suitable r.p.m. in a counterclockwise or clockwise direction to cut the loops 18. The fabric 10 may be dyed in conventional fashion or the fibers 12 may have been stock dyed or solution dyed the desired color so that the finished fabric would reflect that color.

As discussed previously, FIG. 7 shows a modification of the invention in which the batt includes a pre-determined amount of low melt fusible fibers which will fuse the batt 14 in the oven 28. The particular low melt fusible fiber and the amount blended is not specifically critical except that in the preferred form of the invention the batt 14 is a blend of 80%, 18 denier $3\frac{1}{4}$ solution dyed polypropylene fibers and 20%, 6 denier $1\frac{7}{8}''$ clear polyethylene. The amount of low melt fusible fiber can vary from 10–35% and the amount of remaining fibers shall vary accordingly. In the preferred case above the oven is operated at approximately 275° F. for a period of five minutes to heat set the batt 14.

Depending on the use of the non-woven fabric made by fusing the low melt fibers with the remaining fibers in the batt, numerous treatments may be made. The fabric can be needled to form loops with the loops remaining intact or cut as shown in FIGS. 1–7. The fabric can also be needled only for use as a carpet backing material, etc. The treatment after fusion depends on the ultimate use of the fabric but usually includes a flexing step to make the fusion bonded batt more pliable and/or flexible. This step may include running through a compactor or over an edge to break up the bond of the fibers during or after cooling of the low melt fibers. Another possibility is to employ a set of rotating wheels to work the surface of the batt. All of these treatments are directed to provide pliability to otherwise a stiff, boardy fabric.

Fabrics made by the fusion bonding step of bonding the low melt fibers to the other fibers in the batt provides a fabric which is non-boardy with excellent appearance and can be readily sewn if the use of same requires such.

Although the preferred embodiments of the invention have been described, it is contemplated that changes may be made without departing from the scope or spirit of the invention and it is desired that the invention be limited only by the scope of the claims.

I claim:

1. The method of providing a non-woven fabric comprising: blending synthetic staple fibers with low melt fusible fibers and forming them into a batt, said low melt fusible fibers comprising 10–35% of the blend, needling the batt of blended fibers, subjecting the needled batt of fibers to a temperature above the melting temperature of the low melt fusible fibers for a period of time, allowing the fusible fibers to cool to provide a cohesive composite non-woven fabric and treating the composite non-woven fabric during cooling thereof to provide flexibility thereto after it cools.

* * * * *